US008029380B1

(12) United States Patent
Johansen

(10) Patent No.: US 8,029,380 B1
(45) **Date of Patent: *Oct. 4, 2011**

(54) GOLF PUTTING TRAINING APPARATUS AND METHOD OF TRAINING A GOLFER TO USE A PUTTER

(76) Inventor: Chad Johansen, Warrenville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/798,892

(22) Filed: Apr. 13, 2010

Related U.S. Application Data

(63) Continuation-in-part of application No. 12/798,604, filed on Apr. 7, 2010.

(51) Int. Cl.
*A63B 69/36* (2006.01)

(52) U.S. Cl. ..... 473/257; 473/261

(58) Field of Classification Search ..... 473/257, 473/258, 260–269; D21/791
See application file for complete search history.

(56) References Cited

U.S. PATENT DOCUMENTS

| | | | | |
|---|---|---|---|---|
| D199,127 | S | 9/1964 | Nelson | |
| 4,805,912 | A | 2/1989 | Hickman | |
| 5,131,659 | A * | 7/1992 | Lindberg, Jr. | 473/267 |
| D332,817 | S * | 1/1993 | Mullen | D21/791 |
| 5,209,484 | A * | 5/1993 | Randall | 473/265 |
| D338,512 | S | 8/1993 | Crow et al. | |
| 5,294,124 | A * | 3/1994 | Florian | 473/267 |
| 5,332,211 | A * | 7/1994 | Rife et al. | 473/258 |
| 5,351,962 | A | 10/1994 | Lin | |
| D354,107 | S | 1/1995 | Kueng et al. | |
| 5,409,231 | A * | 4/1995 | Kueng et al. | 473/261 |
| D384,385 | S | 9/1997 | Farage | |
| D387,836 | S | 12/1997 | Farnsworth | |
| 6,129,639 | A * | 10/2000 | Brock et al. | 473/260 |
| D461,517 | S | 8/2002 | Morgan et al. | |
| 6,773,357 | B2 * | 8/2004 | Tai et al. | 473/195 |
| D520,096 | S | 5/2006 | Orestwich | |
| D558,849 | S | 1/2008 | Taira et al. | |
| 2002/0169029 | A1 | 11/2002 | Bradbury | |
| 2006/0258477 | A1 | 11/2006 | Sheridan | |

OTHER PUBLICATIONS

International Searching Authority/USPTO; International Search Report regarding PCT/US2011/00608; Jun. 9, 2011; 2 pages.
International Searching Authority/USPTO; Written Opinion of the International Searching Authority regarding PCT/US2011/00608; Jun. 9, 2011; 9 pages.

* cited by examiner

*Primary Examiner* — Nini Legesse
(74) *Attorney, Agent, or Firm* — Law Office of John W. Harbst

(57) ABSTRACT

A golf putting training apparatus for improving a golf stroke along a line of intended travel of a golf ball. The golf training apparatus includes a pair of upright supports and an eye alignment tool for aligning a user's eyes above the apparatus and in a vertical plane that includes the golf ball and the line of intended travel. The eye alignment tool is supported by and connected between the supports and above the golf ball and includes a substantially linear top edge and pair of generally parallel planar sides depending from the top edge toward a bottom edge. With the golf putting training apparatus further including a longitudinally elongated tool arranged under the lower bottom edge of said eye alignment tool and extending along the line of intended travel of said golf ball. A method of training a golfer to use a putter used by the golfer during a golf putting stroke is also disclosed.

17 Claims, 8 Drawing Sheets

GOLF PUTTING TRAINING APPARATUS AND METHOD OF TRAINING A GOLFER TO USE A PUTTER

CROSS-REFERENCE TO RELATED APPLICATIONS

This patent application is a Continuation-In-Part of my co-pending patent application Ser. No. 12/798,604 filed on: Apr. 7, 2010.

FIELD OF THE INVENTION DISCLOSURE

This invention disclosure generally relates to the game of golf and, more particularly, to a golf putting training apparatus and method of training a golfer to use a putter.

BACKGROUND OF THE INVENTION DISCLOSURE

Golf is a popular game but one that is technically demanding. Learning correct techniques to be used on a golf course can lead to significant improvements in a golfer's performance and, thus, lead to lower scores. To become a better golfer, a golfer must master consistency in all aspects of their various swings.

The putting stroke is only one of several types of golf swings, yet it accounts for nearly half of all swings made during regulation play. Despite its rather innocent-looking appearance, and as any good golfer knows, the ability to accurately and consistently putt a golf ball is a very difficult skill to develop, acquire and maintain.

During putting, a golfer typically imagines a target line between the position of the ball on the green or putting surface and the golf cup or "hole." The target line imagined by the golfer is that path for the ball which, if followed, results in the ball landing in the cup. To properly envision the target line, it is helpful for a golfer to vertically align their line of sight with a vertical plane which is perpendicular to the putting green or surface and passes through the centerline of the ball. If the golfer's line of sight is not aligned in this manner, it is less likely the golfer will correctly envision the target line, and more likely the golfer will envision a line that does not lead the ball to the cup thereby adding frustration to the game and the golfer. Even if the remainder of the golfer's putting stroke is perfect, the ball is likely to follow the improperly envisioned line, rather than the target line and not land in the cup.

Even if the golfer does properly envisions the target line, the ball can still miss the cup if the club face or striking surface of the putter does not travel along a target line during the golfer's putting stroke. Additionally, and even if the golfer does properly envision the target line and swings the club face of the putter in line with the target line during the putting stoke, the ball can nevertheless still miss the cup if the striking surface or club face of the putter is not square to the ball when the club face contacts the ball. In order to develop an accurate and consistent putting stroke, the golfer will find it helpful to combine each of the elements of properly aligning the golfer's line of sight over the target line, swing the putter club face in line with the target line, and squaring the club face of the putter when the club face contacts the ball.

In view of the foregoing, there is continuing need and desire for a golf putting training apparatus in which a correct putting swing can be taught along with a method for training a user to swing a golf putter.

SUMMARY OF THE INVENTION DISCLOSURE

According to one aspect of this invention disclosure there is provided a golf putting training apparatus that includes a first upright support, a second upright support, and an eye alignment tool for locating a user's eyes above the apparatus. The eye alignment tool includes a single elongated guide member supported by and connected between the supports and laterally centered above the golf ball. The guide member includes a substantially linear top edge defining a singular line of intended travel for the golf ball and pair of generally parallel planar sides depending from the top edge toward a lower bottom edge. The golf putting training apparatus further includes a longitudinally elongated tool arranged under the lower bottom edge of the eye alignment tool and extending along the singular line of intended travel of the golf ball. The elongated tool has an upper surface upon which the golf ball can rest, and with the upper surface of the elongated tool enhancing viewing at least one of the planar sides of the guide member of the eye alignment tool when a user's eyes are located in other than a vertical plane extending generally perpendicular to a putting surface, and with the vertical plane being aligned with the center of the golf ball and the singular line of intended travel for the ball.

Preferably, the longitudinally elongated tool of the golf putting training apparatus is generally equal to or greater in length than the eye alignment tool. In one form, the longitudinally elongated tool of the golf putting training apparatus has a length which is significantly greater than a width of said longitudinally elongated tool. The width of the longitudinally elongated tool is preferably greater than the diameter of a regulation size golf ball. In another form, the longitudinally elongated tool defines a series of openings along the length thereof, with each opening being generally aligned with a longitudinal axis of the elongated tool for facilitating placement of the gold ball beneath the eye alignment tool.

In another form, the finish on the upper surface of the elongated tool is different from that provided on the planar sides of the guide member of the eye alignment tool whereby enhancing viewing at least one of the planar sides of the guide member of the eye alignment tool when a user's eyes are located in other than a vertical plane extending generally perpendicular to a putting surface. Preferably, the longitudinally elongated tool also includes a lower surface adapted to lie on the putting surface when the longitudinally elongated tool is arranged under the lower bottom edge of the guide member of the eye alignment tool, and with the lower surface being provided with a finish thereon. In another embodiment, the longitudinally elongated tool defines a centrally disposed indicator extending between the ends of the longitudinally elongated tool for facilitating alignment of the longitudinally elongated tool with the single line of intended travel for the golf ball.

According to another aspect, there is provided a golf putting training apparatus including a first upright support, a second upright support, and an elongated rigid eye alignment tool for locating a user's eyes above the apparatus and in a vertical plane extending generally perpendicular to a putting surface. The eye alignment tool includes a single elongated guide member supported by and connected between the supports and laterally centered above a golf ball on the putting surface. The guide member includes a substantially linear top edge defining a singular line of intended travel for the golf ball and pair of generally parallel sides depending from said top edge toward a lower bottom edge. The golf putting training apparatus further includes a longitudinally elongated tool arranged under the lower bottom edge of the guide member of the eye alignment tool and extending along the single line of intended travel of the golf ball. The elongated tool has an upper surface upon which the golf ball can rest, and with the upper surface of the elongated tool enhancing viewing of at least one of the planar sides of the guide member of the eye alignment tool when a user's eyes are located in other than a vertical plane extending generally perpendicular to a putting surface, and with the vertical plane being aligned with the center of the golf ball and the single line of intended travel for the ball.

Preferably, the longitudinally elongated tool of the golf putting training apparatus is generally equal to or greater in length than the eye alignment tool. In one form, the longitudinally elongated tool of the golf putting training apparatus has a length which is significantly greater than a width of the longitudinally elongated tool. In another embodiment, the longitudinally elongated tool defines a centrally disposed indicator extending between the ends of the longitudinally elongated tool for facilitating alignment of the longitudinally elongated tool with the single line of intended travel for the golf ball. In a preferred embodiment, the longitudinally elongated tool defines a series of openings along the length thereof, with each opening being generally aligned with a longitudinal axis of the elongated tool for facilitating placement of the gold ball beneath the eye alignment tool.

In one form, the planar surfaces on the guide member of the eye alignment tool provide an enhanced visual indication when the user's eyes are located in other than the vertical plane. In this form, the upper surface of the elongated tool is different from the majority of the surface on the planar sides of the guide member of the eye alignment tool whereby enhancing viewing at least one of the planar sides of the guide member of the eye alignment tool when a user's eyes are located in other than a vertical plane extending generally perpendicular to a putting surface. In another form, the longitudinally elongated tool also includes a lower surface extending generally parallel to the upper surface and which is adapted to lie on the putting surface when the longitudinally elongated tool is arranged under the lower bottom edge of the guide member of the eye alignment tool. In this form, the lower surface on the elongated tool is treated different from the surface on the majority of the planar sides of the guide member of the eye alignment tool whereby enhancing viewing at least one of the planar sides of the guide member of the eye alignment tool when a user's eyes are located in other than a vertical plane extending generally perpendicular to a putting surface.

According to another aspect, there is provided a method of training a golfer to use a putter having a putting head with a reference marker extending across a striking face thereof and which is to be used by the golfer to strike a golf ball during a golf putting stroke. Such method includes the steps of: arranging a golf training apparatus in operable combination with a golf ball on a putting surface, with the golf training apparatus including a pair of upright supports and an eye alignment tool. The eye alignment tool includes a single elongated guide member supported by and connected between the supports and laterally centered above the golf ball. The guide member includes a substantially linear top edge defining a singular line of intended travel for the ball and pair of generally parallel planar sides depending from the top edge toward a lower bottom edge of the guide member. Another step in the method involves: using the planar sides of the guide member to locate the golfer's eyes above the apparatus and in a vertical plane that includes the golf ball and the single line of intended travel such that the top edge and an extent of the planar sides of the guide member of the eye alignment tool are viewable to the golfer. Such method further includes the step of: arranging a longitudinally elongated tool under the lower bottom edge of the guide member of the eye alignment tool and extending along the single line of intended travel of the golf ball, with the elongated tool having an upper surface upon which the golf ball can rest, and with the upper surface of the elongated tool enhancing viewing of at least one of the planar sides of the single guide member of the eye alignment tool when a user's eyes are located in other than a vertical plane extending generally perpendicular to a putting surface, and with the vertical plane being aligned with the center of the golf ball and the single line of intended travel for the golf ball.

Preferably, the method of training a golfer includes the further step of: aligning a reference marker on the elongated tool with the single line of intended travel of the ball.

DETAILED DESCRIPTION

Figure 1:
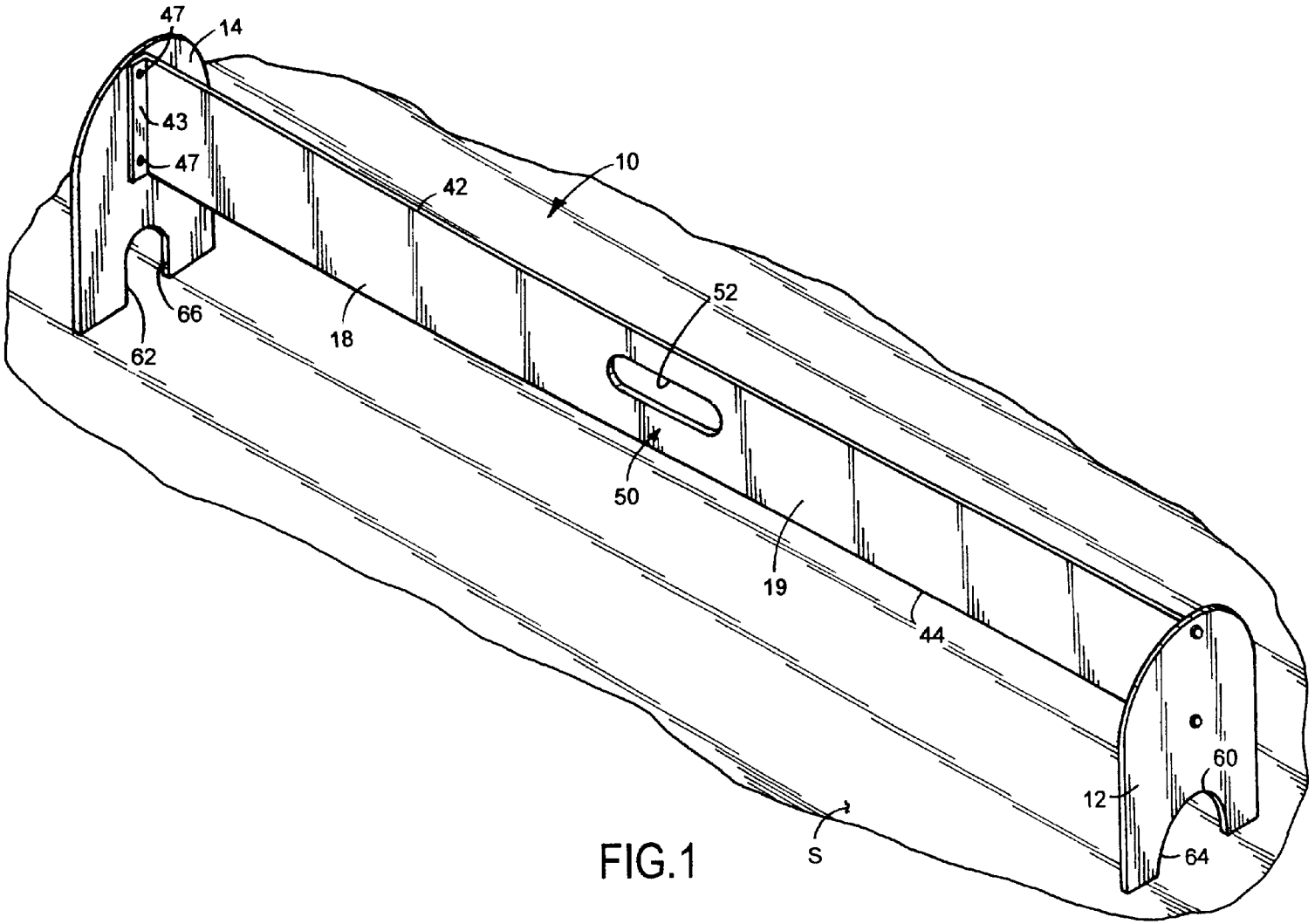
FIG. 1 is a perspective view of one form of a golf training putting training apparatus embodying principals of this invention disclosure.

While this invention disclosure is susceptible of embodiment in multiple forms, there is shown in the drawings and will hereinafter be described a preferred embodiment, with the understanding the present disclosure sets forth an exemplification of the disclosure which is not intended to limit the disclosure to the specific embodiment illustrated and described.

Referring now to the drawings, wherein like reference numerals indicate like parts throughout the several views, in FIG. 1 there is shown a golf putting training apparatus, generally indicated by reference numeral 10, which embodies principals of this invention disclosure and is arranged on a putting surface S. As shown in FIG. 1, the golf putting training apparatus 10 includes a first upright and rigid support 12, a second upright and rigid support 14, along with a rigid and longitudinally elongated eye alignment tool 18.

Support 12 is preferably fabricated from a suitable metal material such as aluminum or the like. In the embodiment illustrated in FIGS. 1 and 2, support 12 extends upwardly or vertically in a direction preferably perpendicular to the putting surface S. Similarly, support 14 is preferably fabricated from a suitable metal material such as aluminum or the like. In the embodiment illustrated in FIGS. 1 and 2, support 14 extends upwardly or vertically in a direction preferably perpendicular to the putting surface S.

The eye alignment tool 18 has an elongated configuration and is likewise preferably formed from a suitable metal material such as aluminum or the like. In the embodiment illustrated in FIGS. 3 and 4, the eye alignment tool 18 includes a single elongated guide member 19 having a substantially linear upper or top edge 42, a lower or bottom edge 44, and a pair of generally parallel planar side surfaces 46 and 48 (FIG. 2) extending between edges 42 and 44. In one form, guide member 19 has a generally rectangular configuration between the edges thereof. In a preferred embodiment, guide member 19 has a length (the distance between opposed ends) ranging between about 42 inches to about 47 inches and a height (the vertical distance between the top and bottom edges 42 and 46) of about 3.5 inches and about 4.5 inches. In a most preferred form, guide member 19 has a length of about 45.2 inches and a height of about 4.0 inches. Moreover, guide member 19 has a thickness (the distance between the planar surfaces 46 and 48) ranging between about 0.097 inches and about 0.187 inches. In a preferred form, guide member 19 has a thickness of about 0.125 inches.

Figure 2:
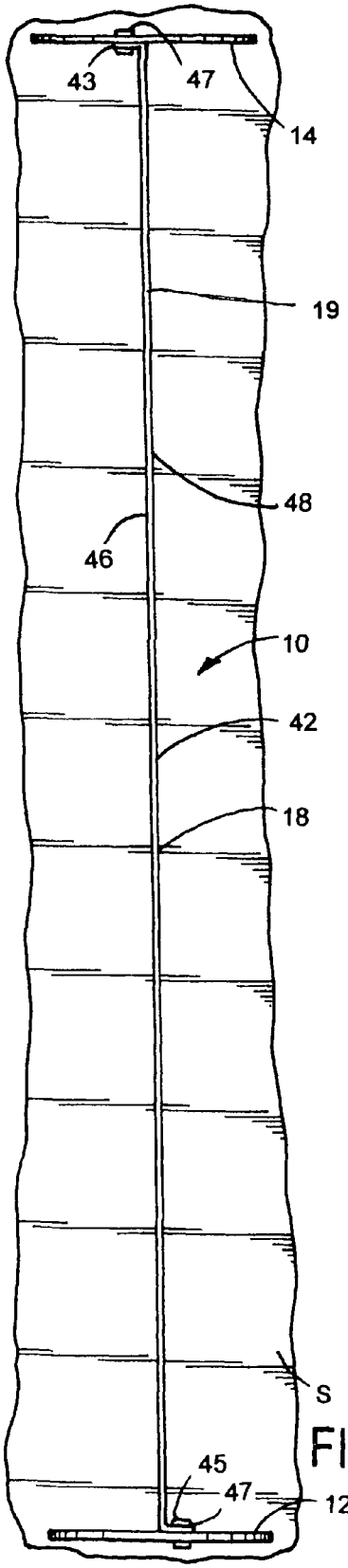
FIG. 2 is a top plan view of the golf putting training apparatus illustrated in FIG. 1.
Figure 3:
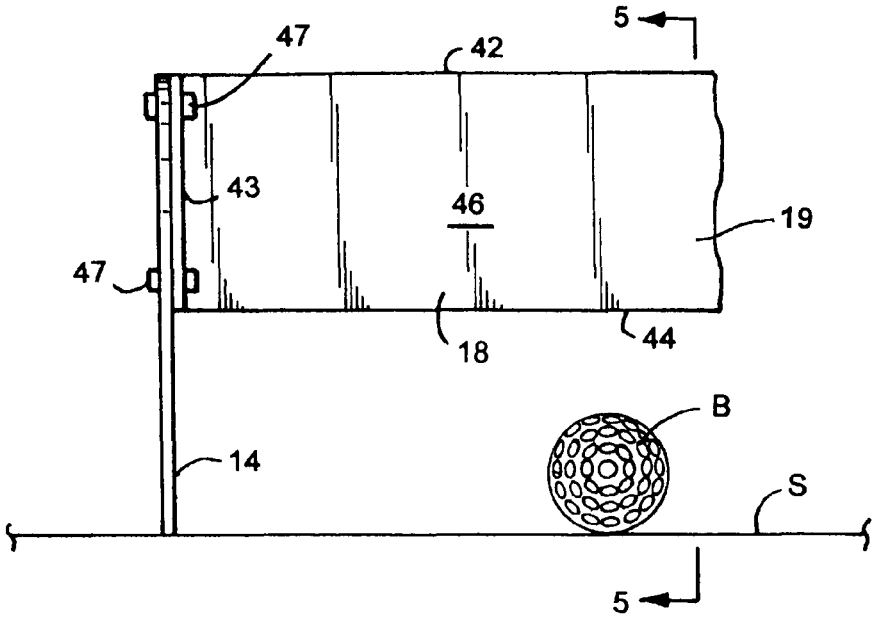
FIG. 3 is an enlarged fragmentary elevational view of one end of the golf putting training apparatus illustrated in FIG. 1.

As illustrated by way of example in FIGS. 2 and 3, one end of the guide member 19 is provided with a mounting flange 43 to facilitate releasable attachment of that end of the tool toward an upper end of the support 12. Any suitable form of fasteners 47 including a threaded bolt and nut combination can be used to operably connect the end of guide member 19 to support 12.

Figure 4:
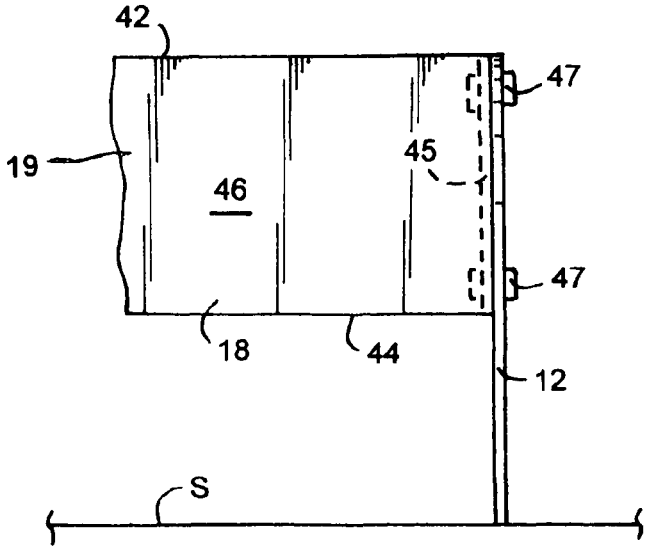
FIG. 4 is an enlarged fragmentary elevational view of an opposite end of the golf putting training apparatus illustrated in FIG. 1.

As illustrated by way of example in FIGS. 2 and 4, an opposite end of the guide member 19 is provided with a mounting flange 45 to facilitate releasable attachment of the end of the guide member 19 toward an upper end of the support 14. Again, any suitable form of fasteners 47 including a threaded bolt and nut combination or other forms of releasable fasteners can be used to operably connect the end of guide member 19 to support 14. The releasable attachment of guide member 19 to supports 12, 14 facilitates handling, shipping and overall transportation of apparatus 10. It is also within the spirit and scope of this invention disclosure to allow the guide member 19 to be operably connected to the supports 12 and 14 so as to allow for adjustment of the vertical spacing under and between the lower or bottom edge 44 of tool 18 and the putting surface S (FIG. 3). In one form, such adjustments can be affected through the provision of elongated vertical slots in either the attachment flange portions of tool 18 or through elongated slots in the supports 12, 14.

Figure 5:
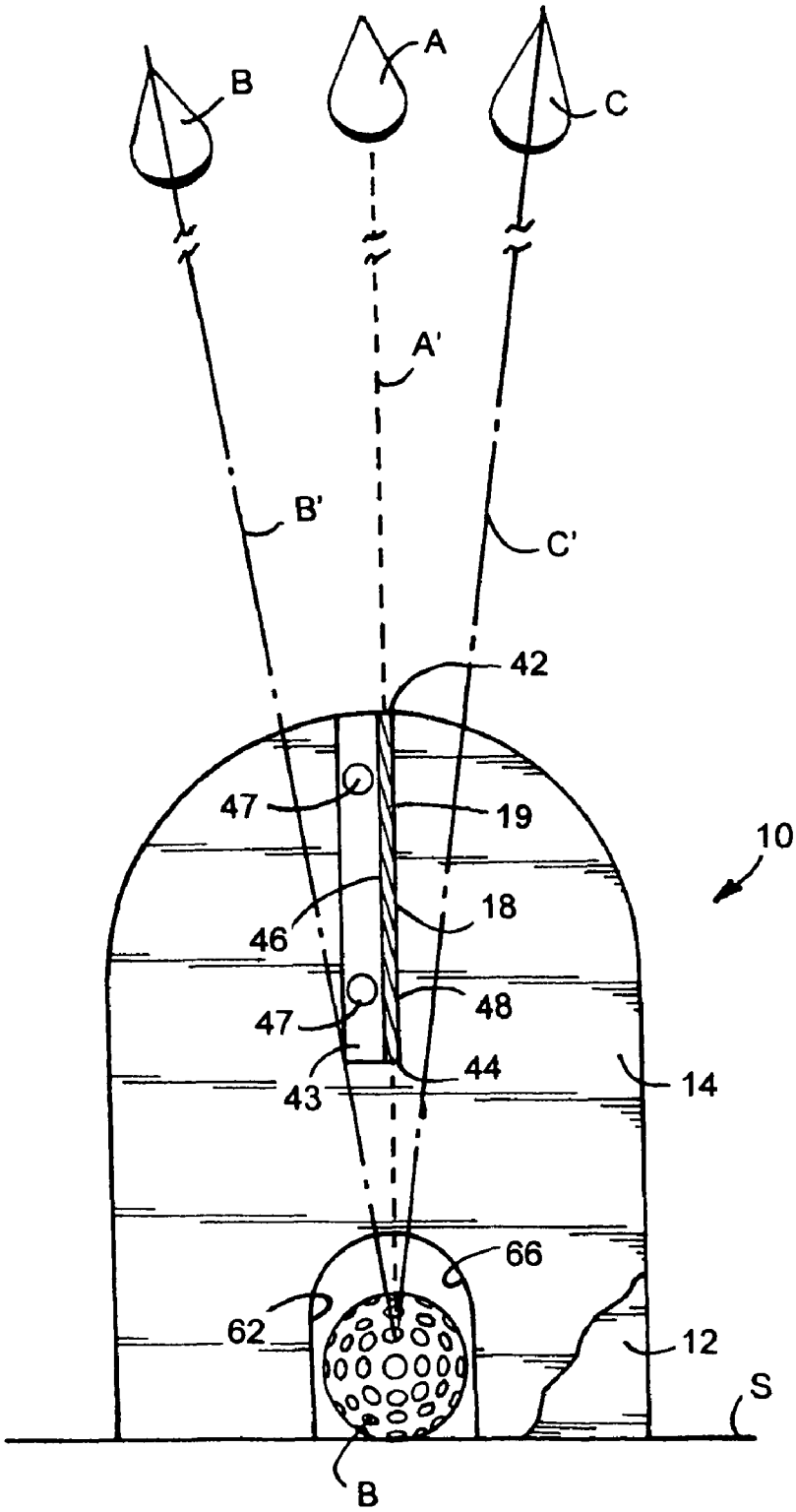
FIG. 5 is an enlarged sectional view taken along line 5-5 of FIG. 3 and illustrates how the golf putting training apparatus enables the golfer to judge whether their eyes are in alignment in a vertical plane over a golf ball.
Figure 13:
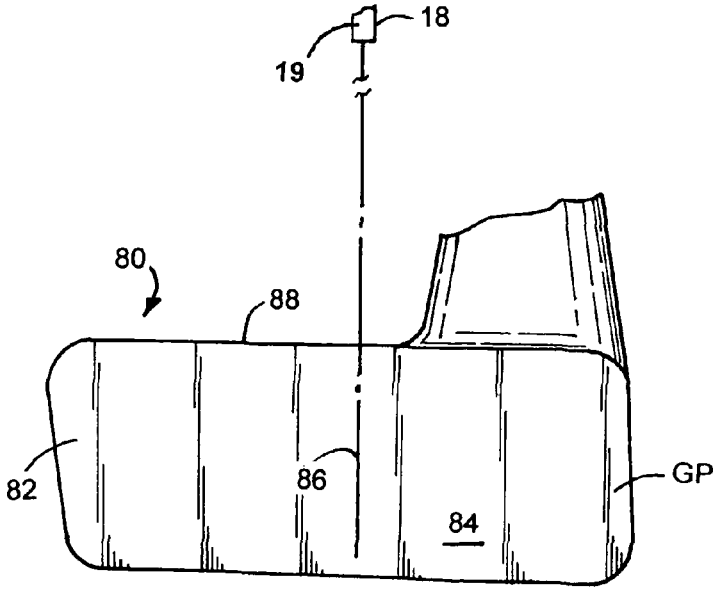
FIG. 13 is a fragmentary showing of a conventional golf putter.

As shown in FIGS. 3 and 4, when guide member 19 is operably joined to supports 12, 14, the lower or bottom edge 44 of guide member 19 is vertically spaced from the putting surface S a sufficient distance to permit a regulation size golf ball B (FIG. 3) to be placed thereunder and with sufficient' room such that a head of a conventional golf putter 80 (FIG. 13) can fit thereunder in a manner permitting a golfer to practice their putting swing movements. As shown in FIG. 5, and when guide member 19 is operably joined to supports 12, 14, the sides 46 and 48 of the guide member 19 are disposed in a vertical plane extending generally perpendicular to the putting surface S. Notably, and during use of apparatus 10, the upper or top edge 42 of the guide member 19 defines a single target line TL (FIGS. 6, 7 and 8) which is a preferred path for a golf ball to follow as it passes toward a target.

In one embodiment of apparatus 10, the upper or top edge 42 of the guide member 19 is highlighted by treating or otherwise being provided with coloring, i.e., white paint or other suitable indicator for enhancing a golfer's perception of the line of travel to be taken by a golf ball during use of apparatus 10. Moreover, the planar sides 46 and 48 of the guide member 19 are also preferably highlighted by treating or otherwise being provided with coloring, i.e. a brightly colored paint other than or different from that used on the top edge 42 or other suitable indicator. Of course, the opposed sides 46 and 48 could each have an individual color or indicator thereon different from the top edge 42 of guide member 19 and different from each other without detracting or departing from the spirit and scope of this disclosure.

Returning to FIG. 1, apparatus 10 furthermore preferably includes a handle 50 for facilitating transportation of apparatus 10 between locations. In a preferred form, and to limit detractions to the golfer using apparatus 10, the handle 50 preferably includes an elongated slot or opening 52 in guide member 19 approximately midlength between opposed ends thereof. Preferably, the opening 52 in guide member 19 has a closed margin and extends laterally through the guide member 19 such that no projections extend outwardly from opposed sides 46, 48 of the guide member 19 which could prove to be detractions for the user of apparatus 10.

Figure 9:
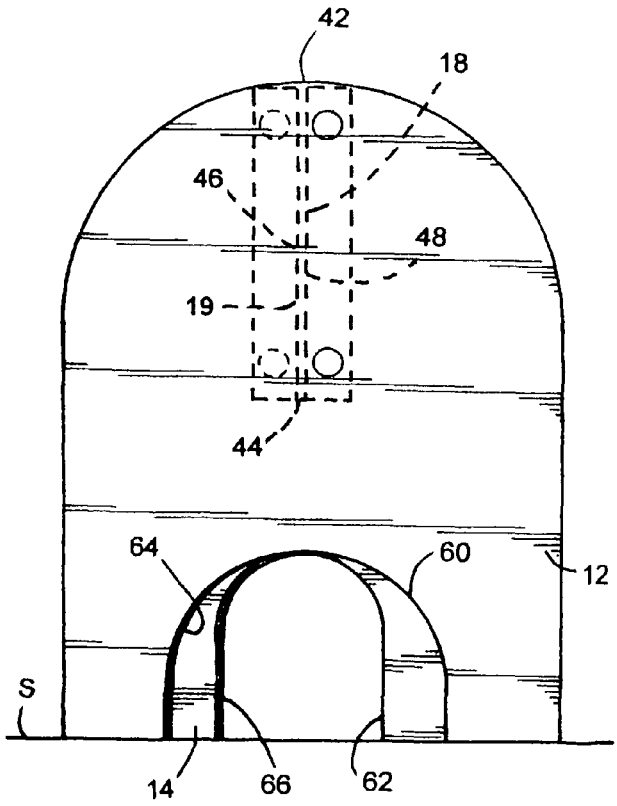
FIG. 9 is an enlarged end view of the golf putting training apparatus illustrated in FIG. 1.

In the exemplary form illustrated in FIG. 9, at least one of the supports 12, 14 of apparatus 10 defines a target 60. In a preferred form, each of the supports 12, 14 defines a target 60, 62, respectively. Preferably, each target 60, 62 is centered with respect to the intended travel of the golf ball B or the single target line TL during practice. Each target 60, 62 defined by the supports 12, 14, respectively, is at least as large as regulation size golf ball. In a preferred form, each target 60, 62 is defined by an opening 64, 66, respectively, in the respective support 12, 14.

Figure 10:
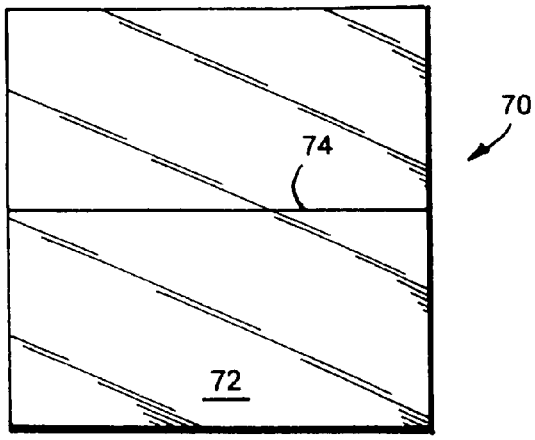
FIG. 10 is a plan view of a reflective device which can be used in operable combination with the golf putting training apparatus of this invention disclosure.
Figure 12:
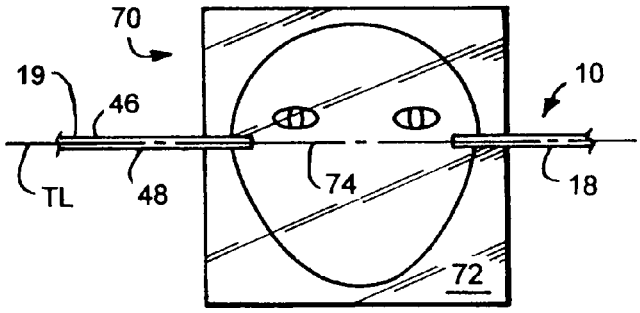
FIG. 12 is a fragmentary schematic representation of the image provided by the reflective device when used in operable combination with the golf putting training apparatus of this invention disclosure.
Figure 11:
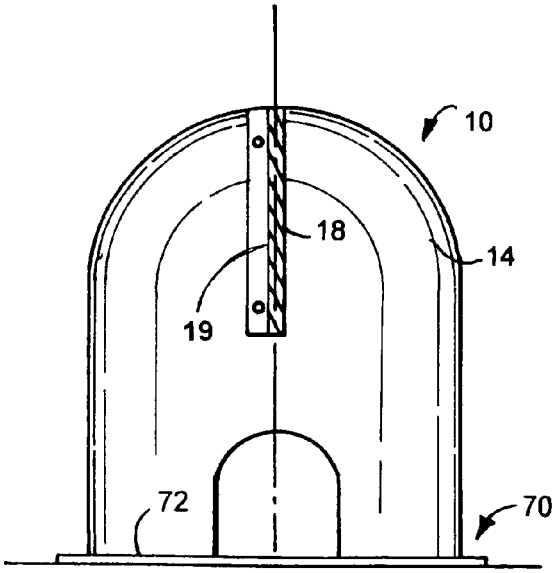
FIG. 11 is an end view illustrating the reflective device shown in FIG. 10 in operable combination with the golf putting training apparatus of this invention disclosure.

According to another aspect of the present disclosure, and as shown in FIGS. 10, 11 and 12, there is provided a reflective device 70 adapted for use in combination with the golf putting training apparatus 10. In the illustrated embodiment, the reflective device 70 has a reflective surface 72 and, as schematically represented in FIG. 12, is sized to reflect the face of the golfer using the golf putting training apparatus 10. As illustrated in FIG. 10, the reflective device 70 is provided with a line or indicator 74 preferably extending thereacross.

When arranged in operable combination with the golf putting training apparatus 10, and as shown in FIGS. 11 and 12, the reflective device 70 is positioned or placed under the guide member 19 of the eye alignment tool 18 with the reflective surface 72 facing toward the tool 18 and with the line or indicator 74 on surface 72 (FIG. 12) being aligned with the single target line TL defined by the guide member 19 of the eye alignment tool 18. The purpose of device 70 is to provide the user of apparatus 10 with an immediate visual indication of any unwanted and inadvertent head movements along with eye alignment relative to the vertical plane defined by the eye alignment apparatus 18 and the centerline of the golf ball during a putting stroke.

Figure 14:
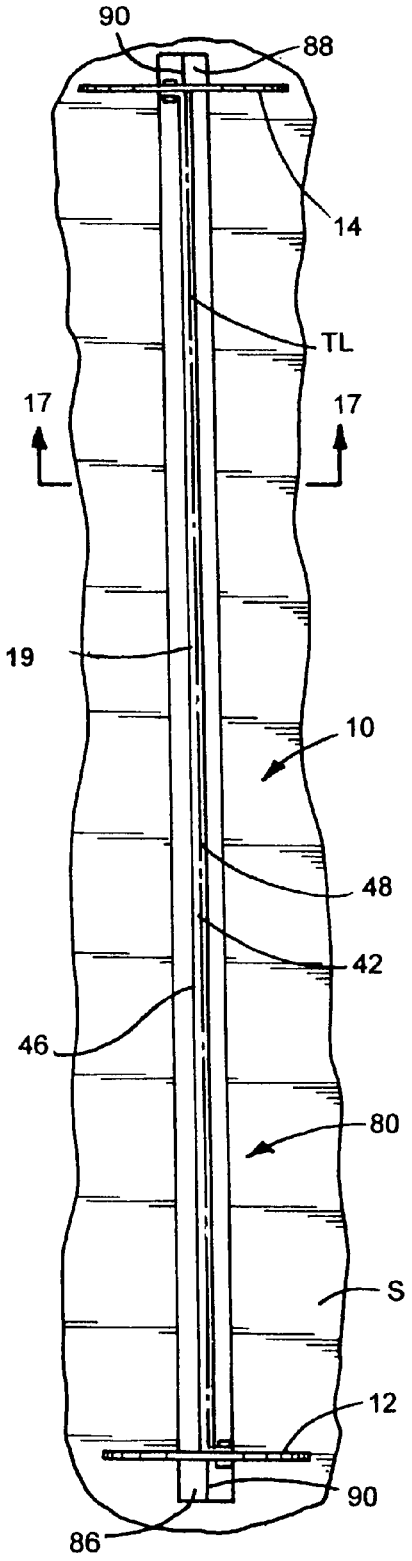
FIG. 14 is a view similar to FIG. 2 showing another aspect of this invention disclosure.

According to another aspect of the present disclosure there is provided a longitudinally elongated tool 80 which, when arranged in operable combination with and part of the golf putting training apparatus 10, is arranged under the lower bottom edge 44 (FIG. 17) of the guide member 19 of the eye alignment tool 18. Preferably, and as shown in FIG. 14, tool 80 extends along the single line of intended travel TL of the golf ball (not shown).

Tool 80 is preferably formed from a suitable metal material such as aluminum or the like. In the embodiment illustrated in FIGS. 15 and 16, tool 80 includes a pair of generally parallel major planar upper and lower surfaces 82 and 84 (FIG. 16), respectively, extending between the side edges 83 and 85 and between opposed ends 86 and 88. During use, a ball is positioned on the upper surface 82 while the lower surface 84 is adapted to lie on the putting surface S during use of apparatus 10. Of course, the tool 80 is reversible to enhance the dexterity and usefulness thereof. In one form, tool 80 has a length (the distance between opposed ends 86, 88) ranging between about 46 inches to about 49 inches and a width (the distance between the side edges 83 and 85) of about 1.125 inches and about 2 inches. In a most preferred form, tool 80 has a length of about 47 inches and a width of about 1.25 inches. Moreover, tool 80 has a thickness (the distance between the planar upper and lower surfaces 82 and 84, respectively) ranging between about 0.097 inches and about 0.187 inches. In a preferred form, tool 80 has a thickness of about 0.125 inches.

Figure 15:
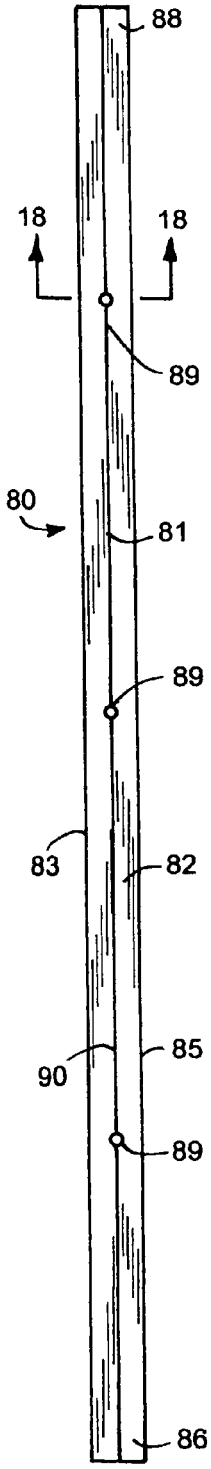
FIG. 15 is top plan view of a longitudinally elongated tool which can be used in operable combination with the golf putting training apparatus illustrated in FIG. 1.
Figure 16:
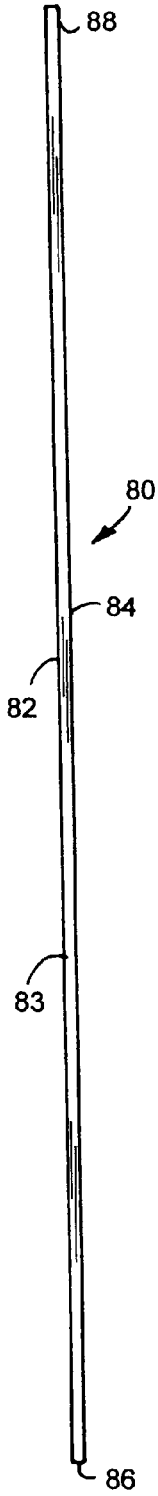
FIG. 16 is a side elevation of the longitudinally elongated tool illustrated in FIG. 15.
Figure 17:
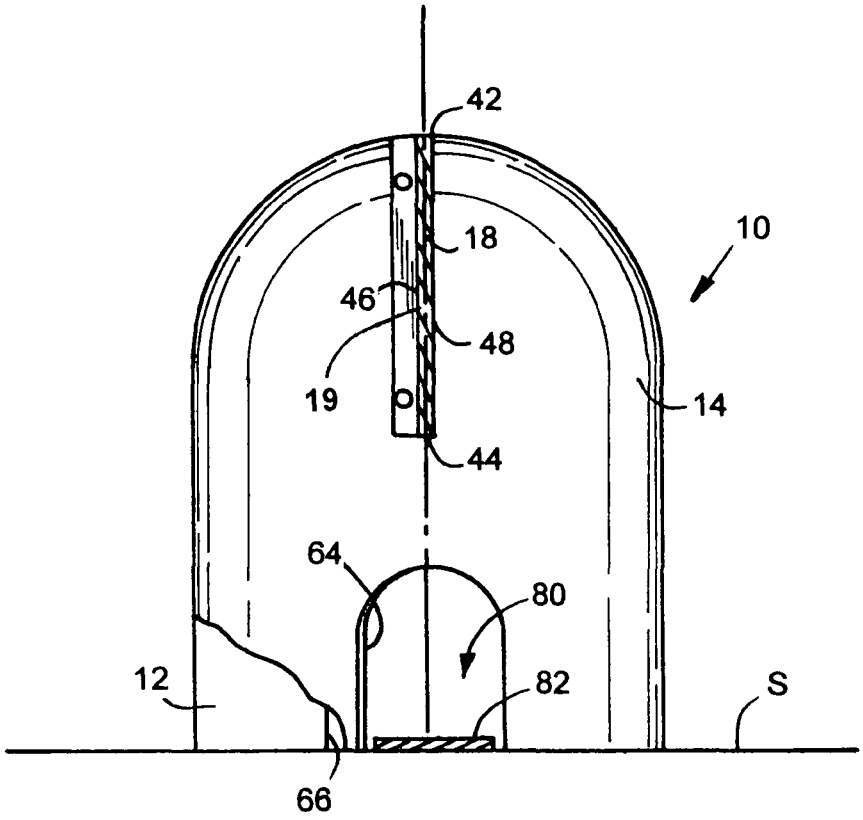
FIG. 17 is a sectional view taken along line 17-17 of FIG. 14.

Suffice it to say, tool 80 is generally equal to or greater in length than the eye alignment tool 18. As shown in FIGS. 15 and 16, tool 80 has a length which is significantly greater than its width. Moreover, it should be understood, the width of tool 80 is less than a diameter of a regulation size golf ball. As such, and when tool 80 is sized longer than the eye alignment tool 18, tool 80 is permitted to fit and extend through the target openings 64, 66 defined by the supports 12, 14, respectively, of apparatus 10 (FIG. 17).

Figure 18:
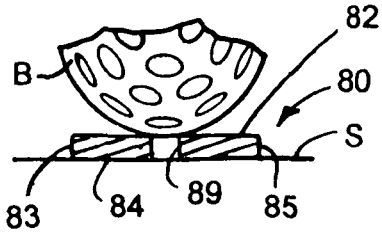
FIG. 18 is an enlarged sectional view taken along line 18-18 of FIG. 15.

As shown in FIG. 15, tool, 80 defines a series of openings 89 along the length thereof. In the illustrated embodiment, tool 80 is shown to define three openings 89; with substantially equivalent longitudinal spacing being provided therebetween. As swill be appreciated, however, lesser or fewer openings could be defined by tool 80 without detracting or departing from the spirt and scope of this invention disclosure. In the preferred form, the openings 89 are generally aligned with a longitudinal axis 81 of tool 80. As illustrated in FIG. 18, the openings 89 facilitate placement of a golf ball B beneath the eye alignment tool 18 and on the upper surface of tool 80.

The upper major surface 82 of tool 80 has a finish thereon for enhancing viewing of at least a portion of at least one of the planar sides 46, 48 of the guide member 19 of the eye alignment tool 18 when a user's eyes are located in other than a vertical plane extending generally perpendicular to the putting surface S and with the vertical plane being aligned with the golf ball and the single line of intended travel TL for the ball. Such finish is preferably in the form of a colored paint or the like which contrasts with or is different from the a majority of the surface provided on the opposed sides 46, 48 of the guide member 19 of the eye alignment tool 18 whereby enhancing viewing of at least a portion of at least one of the planar sides 46, 48 of the guide member 19 of the eye alignment tool 18 during use of apparatus 10. The other major or lower surface 84 of tool 80 likewise preferably has a finish thereon for enhancing viewing of a portion of at least one of the planar sides 46, 48 of the guide member 19 of the eye alignment tool 18 when the tool 80 is reversed from the position illustrated in FIG. 17. Like surface 82, the finish on surface 84 is preferably in the form of a colored paint or the like which contrasts with or is different from a majority of the surface provided on the opposed sides 46, 48 of the guide member 19 of the eye alignment tool 18 whereby enhancing viewing of at least a portion of at least one of the planar sides 46, 48 of the guide member 19 of the eye alignment tool 18 during use of apparatus 10.

As shown in FIG. 15, at least surface 82 of tool 80 is provided with a longitudinally elongated indicator or reference marker 90 thereon. Preferably, surface 84 of tool 80 is likewise provided with a longitudinally elongated indicator or reference thereon. The indicator or marker is 90 is centrally disposed and preferably extends between the ends 86, 88 of the tool 80 for facilitating alignment of the tool 80 relative to the single line of intended travel TL of the ball.

In use, and as shown in FIG. 5, the eye alignment tool 18 of apparatus 10 enables a user to judge when their eyes are located in a vertical plane over the golf ball B. FIG. 5 schematically illustrates the user's eyes in three different positions A, B and C along with the corresponding line of sight A', B' and C'.

Figure 6:
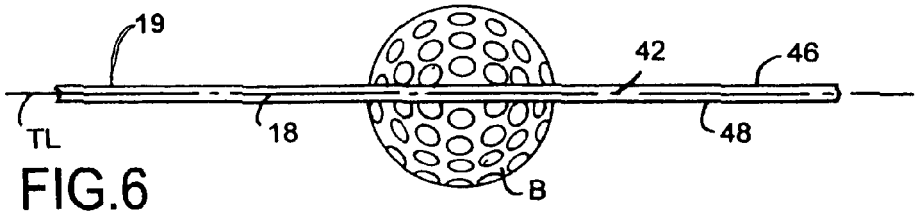
FIG. 6 is a fragmentary and enlarged schematic illustration of what the golfer views when using the golf putting training apparatus of the present disclosure and their eyes are in alignment in a vertical plane over a golf ball.

As will be appreciated from sight line A', and as represented in FIG. 6, when the user's eyes are positioned or located directly over and in alignment with a vertical plane extending perpendicular to the putting surface S and passing through the eye alignment tool 18 and the centerline of golf ball B (as represented in position "A"), the user only sees the top edge 42 of the single elongated guide member 19 of the eye alignment apparatus 18. That is, the user's eyes cannot see either planar side of the 46 or 48 of the guide member 19 of the eye alignment tool 18. Accordingly, the eye alignment tool 18 provides a clear indication the user is located directly over the ball B to affect a proper putting stroke. As will be appreciated from FIG. 6, providing a highlighting indicator, such as paint or the like, along the top edge 42 of the guide member 19 of the eye alignment tool 18 will only serve to enhance a golfer's perception of the single line of intended travel TL to be taken by a golf ball during use of apparatus 10. Testing has revealed having the tool 80 arranged beneath the guide member 19 of the eye alignment tool 18 significantly enhances the ability of the user to view the sides 46, 48 of the guide member 19 of the eye alignment tool 18 and ensure proper eye location during use of the apparatus 10. Of course, and after training on apparatus 10, proper eye location along with proper head and body placement will be automatically affected during a putting stroke.

Figure 7:
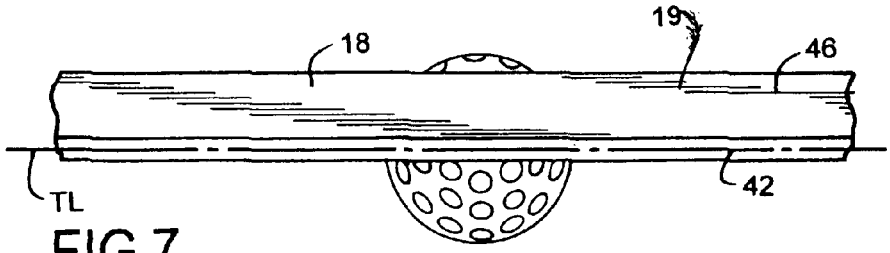
FIG. 7 is a fragmentary and enlarged schematic illustration of what the golfer views when using the golf putting training apparatus of the present disclosure and their eyes are not in alignment in a vertical plane over a golf ball.

When the user's eyes are not in the vertical plane (as represented in position "B") and the user views the eye alignment tool along sight line B', and as represented in FIG. 7, the user will see both the top edge 42 and the planar side 46 of the guide member 19 of the eye alignment apparatus 18. As such, the eye alignment tool 18 will provide the user with a visual image and clear indication their eyes are not located directly over the center of the ball B to affect a putting stroke and the user should relocate to affect proper alignment. As will be appreciated from FIG. 7, providing a high lighting indicator, such as a bright paint color or the like, on surface 46 of the guide member 19 of the tool 18 which is different from the highlighting indicator on the top edge 42 of the guide member 19 of the eye alignment tool 18 will only serve to enhance a user's perception of their vertical alignment relative to the ball B to affect a putt. Moreover, providing a different color or other treatment on the upward facing surface of tool 80 from that provided on the sides 46, 48 of the guide member 19 of the eye alignment tool 18 will furthermore serve to enhance a user's perception of their vertical alignment relative to the ball B to affect a putt while providing an indication of the direction of the location of the user's eyes above apparatus 10 and the single line of intended travel for the ball.

Figure 8:
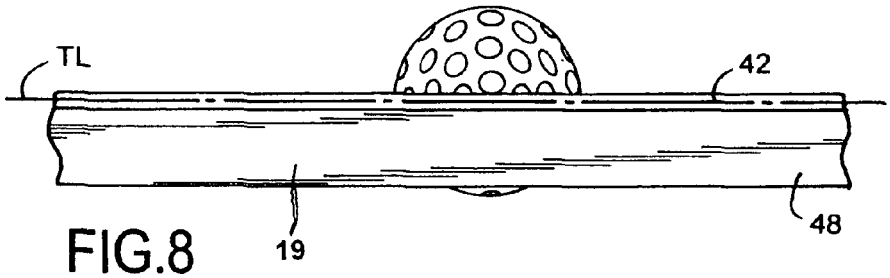
FIG. 8 is a fragmentary and enlarged schematic illustration similar to FIG. 7 showing what the golfer views when using the golf putting training apparatus of the present disclosure and their eyes are not in alignment in a vertical plane over a golf ball.

When the user's eyes are not in the vertical plane (as represented in position "C") and the user views the eye alignment tool along sight line C', and as represented in FIG. 8, the user will see both the top edge 42 and the planar side 48 of the guide member 19 of the eye alignment apparatus 18. As such, the eye alignment tool 18 will provide the user with a visual image and clear indication their eyes are not located directly over the center of the ball B to affect a putting stroke and the user should relocate to affect proper alignment. As will be appreciated from FIG. 8, providing a high lighting indicator, such as a bright paint color or the like, on surface 48 of the guide member 19 of the tool 18 which is different from the high lighting indicator on the top edge 42 of the guide member 19 of the eye alignment tool 18 will only serve to enhance a user's perception of their vertical alignment relative to the ball B to affect a putt. Moreover, providing a high lighting indicator, such as a bright paint color or the like, on a major portion of the planar surface 48 of tool 18 which is different from either the high lighting indicator on the top edge 42 or the high lighting color on a majority of the opposed planar surface 46 of the guide member 19 of the eye alignment tool 18 will only serve to enhance a user's perception of their vertical alignment relative to the ball B to affect a putt while providing an indication of the direction of the location of the user's eyes above apparatus 10 and the single line of intended travel for the ball. Again, providing a different color or other treatment on the upward facing surface of tool 80 from that provided on the sides 46, 48 of the guide member 19 of the eye alignment tool 18 will furthermore serve to enhance a user's perception of their vertical alignment relative to the ball B to affect a putt.

A fragmentary showing of a conventional golf putter is represented generally by reference numeral 80 in FIG. 9. A typical putter 80 includes a putter head 82 defining a generally planar surface or striking face 84. Putter alignment mark(s), generally represented by reference numeral 86, are usually provided on the striking face 84 of the putter 80. Such visual alignment marks or aids 86 can be incorporated into the putter designs and are typically a vertical groove on the face 82 or the top putter surface 88 of the putter head 82. Such grooves can be highlighted by the use of white, black, red or other contrasting colors of paint or colored inserts.

According to another aspect of the present invention disclosure, the eye alignment tool 18 of apparatus 10 furthermore facilitates proper positioning of the club face or striking surface 84 of the putter 80 along the target line TL (FIG. 6) during the golfer's putting stroke. That is, by maintaining the visual alignment marks or aids 86 on the putter 80 in line with the top edge 42 of the upper edge 42 of the guide member 19 of the eye alignment tool 18, proper positioning of the club face or striking surface 82 of the putter 80 along the single target line TL (FIG. 6) during the golfer's putting stroke is enhanced.

According to still another aspect, there is provided a method of training a golfer to use a putter 80 having a putting head 82 with a reference marker 86 extending across a striking face 84 thereof and which is to be used by the golfer during a golf putting stroke. Such method includes the steps of: arranging a golf training apparatus 10 in operable combination with a golf ball B on a putting surface S, with the golf training apparatus 10 including a pair of upright supports 12, 14 and an eye alignment tool 18 extending along a single line of intended travel for the golf ball, with the tool 18 being supported by and connected between the supports 12, 14 and laterally centered above the golf ball B. The eye alignment tool 18 includes a single elongated guide member 19 having a substantially linear top edge 42 defining a single line of intended travel for the golf ball and a pair of generally parallel planar sides 46, 48 depending from the top edge 42 toward a lower bottom edge 46. Another step in the method involves using the planar sides 46, 48 of the guide member to locate the golfer's eyes above the apparatus 10 and in a vertical plane that includes the golf ball and the single line of intended travel such that the top edge 42 and a predetermined extent of the planar sides 46, 48 of the guide member 19 of the eye alignment tool 18 are viewable to the golfer. Another step in the method involves arranging a longitudinally elongated tool 80 under the lower bottom edge 44 of the guide member 19 of the eye alignment tool 18 and extending along the single line of intended travel TL of the golf ball. The elongated tool has an upper surface 82 upon which the golf ball can rest, and with the upper surface 82 of the tool 80 enhancing viewing of at least one of the planar sides 46, 48 of the guide member 19 of the eye alignment tool 18 when a user's eyes are located in other than a vertical plane extending generally perpendicular to a putting surface S, and with said vertical plane being aligned with the center of the golf ball and the single line of intended travel TL for the ball.

The method of training a golfer can include the further step of: aligning the reference marker 86 on the striking face 84 of the putter head 82 with the vertical plane including the golf ball B and the line of intended travel of the ball. Preferably, the method of training a golfer includes the further step of: providing a mirrored or reflective surface 72 sufficiently sized to reflect the golfer's face beneath the ball B and the eye alignment tool 18 of the golf training apparatus 10 such that the golfer can view head movements and eye alignment during a putting stroke.

The method of training a golfer can include the further step of: proving a target 60 on at least one of the supports 12, 14. Alternatively, the method of training a golfer can include the further step of: providing a target opening 64, 66 on the supports 60, 62, respectively, with each opening 64, 66 being defined at least as large as a regulation size golf ball. Moreover, the method of training a golfer can include the further step of: aligning a reference marker 90 on the elongated tool 80 with the single line of intended travel TL of the ball.

From the foregoing, it will be observed that numerous modifications and variations can be made and effected without departing or detracting from the true spirit and novel concept of this invention disclosure. Moreover, it will be appreciated, the present disclosure is intended to set forth exemplifications which are not intended to limit the disclosure to the specific embodiments illustrated. Rather, this disclosure is intended to cover by the appended claims all such modifications and variations as fall within the spirit and scope of the claims.

What is claimed is:

1. A golf putting training apparatus, comprising:

a first upright support;

a second upright support;

an eye alignment tool for locating a user's eyes above the apparatus, with said tool including a single elongated guide member supported by and connected between said supports and laterally centered above a golf ball arranged on a putting surface, with said guide member having a substantially linear top edge defining a single line of intended travel for said ball and a pair of generally parallel planar sides extending perpendicular to the putting surface and depending from said top edge toward a lower bottom edge of said guide member, with the planar sides of said single guide member providing a visual indication whether the user's eyes are located in a vertical plane extending perpendicular to the putting surface and including the golf ball and the single line of intended travel of said ball; and a longitudinally elongated tool arranged under the lower bottom edge of the guide member of said eye alignment tool and extending along the single line of intended travel of said golf ball, with said elongated tool having an upper surface upon which said golf ball can rest, and with said upper surface of said elongated tool having a finish for enhancing viewing at least one of the planar sides of said guide member when a user's eyes are located in other than the vertical plane extending generally perpendicular to a putting surface.

2. The golf putting training apparatus according to claim 1 wherein said longitudinally elongated tool is generally equal to or greater in length than said eye alignment tool.

3. The golf putting training apparatus according to claim 1 wherein said longitudinally elongated tool has a length which is significantly greater than a width of said longitudinally elongated tool.

4. The golf putting training apparatus according to claim 3 wherein the width of said longitudinally elongated tool is greater than the diameter of a regulation size golf ball.

5. The golf putting training apparatus according to claim 1 wherein said longitudinally elongated tool defines a series of openings along the length thereof, with each opening being generally aligned with a longitudinal axis of said elongated tool for facilitating placement of said gold ball beneath said eye alignment tool.

6. The golf putting training apparatus according to claim 1 wherein the finish on the upper surface of said elongated tool is different from a finish provided on a major portion of the planar sides of the guide member of said eye alignment tool whereby enhancing viewing at least one of the planar sides of the guide member of said eye alignment tool when the user's eyes are located in other than said vertical plane extending generally perpendicular to the putting surface.

7. The golf putting training apparatus according to claim 6 wherein said longitudinally elongated tool also includes a lower surface adapted to lie on the putting surface when said longitudinally elongated tool is arranged under the lower bottom edge of said guide member of said alignment tool, and with said lower surface being provided with a finish thereon.

8. The golf putting training apparatus according to claim 1 wherein said longitudinally elongated tool defines indicator disposed generally centrally between opposed longitudinal sides of and extending between opposed ends of said longitudinally elongated tool for facilitating alignment of said longitudinally elongated tool with the intended line of travel for said golf ball.

9. A golf training apparatus, comprising:

a first upright support;

a second upright support;

an elongated rigid eye alignment tool for locating a user's eyes above the apparatus and in a vertical plane extending generally perpendicular to a putting surface, and wherein said tool includes a single elongated guide member supported by and connected between said supports and above a golf ball laterally centered with resect to said guide member, and with said guide member having a substantially linear top edge defining a single line of intended travel of said golf ball and a pair of generally parallel sides extending perpendicular to the putting surface and depending from said top edge toward a lower bottom edge of said guide member, and with a majority of a surface finish on each planar side of said guide member being different from a surface finish on the top edge of said guide member; and a longitudinally elongated tool arranged under the lower bottom edge of said guide member and extending along the single line of intended travel of said golf ball, with said elongated tool having an upper surface upon which said golf ball can rest, and with said upper surface of said elongated tool facilitating viewing of at least one of the planar sides of said guide member when a user's eyes are located in other than a vertical plane extending generally perpendicular to a putting surface, and with said vertical plane being aligned with the center of said golf ball and the line of intended travel for said ball.

10. The golf putting training apparatus according to claim 9 wherein said longitudinally elongated tool is generally equal to or greater in length than said eye alignment tool.

11. The golf putting training apparatus according to claim 9 wherein said longitudinally elongated tool has a length which is significantly greater than a width of said longitudinally elongated tool.

12. The golf putting training apparatus according to claim 9 wherein said longitudinally elongated tool defines a centrally disposed indicator extending between the ends of said longitudinally elongated tool for facilitating alignment of said longitudinally elongated tool with the single intended line of travel for said golf ball.

13. The golf putting training apparatus according to claim 9 wherein said longitudinally elongated tool defines a series of openings along the length thereof, with each opening being generally aligned with a longitudinal axis of said elongated tool for facilitating placement of said golf ball beneath the guide member of said eye alignment tool.

14. The golf putting training apparatus according to claim 9 wherein said guide member is laterally centered relative to said first and second supports.

15. The golf putting training apparatus according to claim 14 wherein said longitudinally elongated tool also includes a lower surface extending generally parallel to said upper surface and which is adapted to lie on the putting surface when said longitudinally elongated tool is arranged under the lower bottom edge of said guide member of said eye alignment tool, and with said lower surface on said elongated tool facilitating viewing of one of the planar sides of said guide member when a user's eyes are located in other than a vertical plane extending generally perpendicular to a putting surface.

16. A method of training a golfer to use a putter having a putting head with a reference marker extending across a striking face there and which is to be used by the golfer to strike a golf ball during a golf putting stroke, said method comprising the steps of:

arranging a golf training apparatus in operable combination with a golf ball on a putting surface, with said golf training apparatus including a pair of upright supports and an eye alignment tool, with said tool including a single elongated guide member supported by and connected between said supports and laterally centered above the golf ball, with said guide member having a substantially linear top edge defining a single line of intended travel for said golf ball and a pair of generally parallel planar sides depending from said top edge toward a lower bottom edge;

using the planar sides of said single guide member to locate the golfer's eyes above the apparatus and in a vertical plane that includes the golf ball and the single line of intended travel such that only the top edge and not the planar sides of the guide member is viewable to the golfer; and arranging a longitudinally elongated tool under the lower bottom edge of said guide member to extend along the single line of intended travel of said golf ball, with said elongated tool having an upper surface upon which said golf ball can rest, and with said upper surface of said elongated tool facilitating viewing of at least one of the planar sides of said guide member when a user's eyes are located in other than a vertical plane extending generally perpendicular to a putting surface.

17. The method of training a golfer according to claim 16 including the further step of:

aligning a reference marker on the elongated tool with the single line of intended travel of said ball.

* * * * *